US012607188B1

(12) United States Patent
Stiles

(10) Patent No.: US 12,607,188 B1
(45) Date of Patent: Apr. 21, 2026

(54) MOVING WALL MULTIPHASE COMPRESSOR-PUMP-EXPANDER SYSTEM

(71) Applicant: David Stiles, Fulshear, TX (US)

(72) Inventor: David Stiles, Fulshear, TX (US)

( * ) Notice: Subject to any disclaimer, the term of this patent is extended or adjusted under 35 U.S.C. 154(b) by 0 days.

(21) Appl. No.: 18/103,459

(22) Filed: Jan. 30, 2023

Related U.S. Application Data

(60) Provisional application No. 63/344,231, filed on May 20, 2022.

(51) Int. Cl.

| | |
|---|---|
| ***F04C 18/344*** | (2006.01) |
| ***F01C 1/344*** | (2006.01) |
| ***F01C 1/39*** | (2006.01) |
| ***F01C 21/08*** | (2006.01) |
| ***F01C 21/10*** | (2006.01) |

(52) U.S. Cl.
CPC ..... *F04C 18/3441* (2013.01); *F01C 1/344* (2013.01); *F01C 1/39* (2013.01); *F01C 21/0809* (2013.01); *F01C 21/108* (2013.01)

(58) Field of Classification Search
CPC .... F01C 1/344; F01C 21/0809; F01C 21/108; F01C 1/3446; F01C 1/39; F01C 1/44; F01C 1/46; F01C 21/08; F04C 18/3441; F04C 18/39
See application file for complete search history.

(56) References Cited

U.S. PATENT DOCUMENTS 3,601,512 A * 8/1971 Kehl ..... F01C 1/44 418/172
3,971,347 A * 7/1976 Vasilantone ..... F01C 1/44 418/269
4,521,167 A * 6/1985 Cavalleri ..... F01C 21/0809 418/268
5,375,985 A * 12/1994 Pipaloff ..... F01C 1/34 418/175
5,597,295 A * 1/1997 Pipaloff ..... F01C 1/34 418/175
5,855,474 A * 1/1999 Shouman ..... F01C 1/34 418/6
6,030,195 A * 2/2000 Pingston ..... F04C 2/3446 418/268
6,846,163 B2 * 1/2005 Takahashi ..... F01B 13/068 92/72
11,215,177 B2 * 1/2022 Borchers ..... F01C 21/0863
11,891,948 B1 * 2/2024 Stiles ..... F02B 53/10
2012/0034123 A1 * 2/2012 Schultz ..... F01C 21/08 418/144
2018/0058448 A1 * 3/2018 Patterson ..... F01C 21/0809
2018/0163543 A1 * 6/2018 Morton ..... F04C 2/3446
2018/0306182 A1 * 10/2018 Maki ..... F04C 2/344
2021/0108634 A1 * 4/2021 Meinig ..... F01C 21/108
2022/0010795 A1 * 1/2022 Ohmori ..... F04C 15/06

* cited by examiner

*Primary Examiner* — Dominick L Plakkoottam
(74) *Attorney, Agent, or Firm* — LEAVITT & ELDREDGE; Richard Eldredge

(57) ABSTRACT

A moving wall multiphase compressor-pump-expander system utilizes the relative rotation of a ring, a central body, and a housing with respect to each other, where the ring is concentrically positioned in a channel between the central body and the housing. The ring has a series of vanes passing through it and pivotally attached on each side to the walls of the channel in the housing to compress a fluid. The channel has low friction walls on either side to reduce the friction between the vanes the walls. The system is able to compress and expand fluids and as such can function as a pump.

10 Claims, 6 Drawing Sheets

MOVING WALL MULTIPHASE COMPRESSOR-PUMP-EXPANDER SYSTEM

BACKGROUND

1. Field of the Invention

The present invention relates generally to compressor systems, and more specifically, to a multiphase compression system for altering the pressure of a fluid.

2. Description of Related Art

Compressor systems are well known in the art and are effective means to pressurize a fluid such as air and store it for later use. For example, FIG. 1 depicts a conventional piston compressor system 101 having block 103 with a bore 105 wherein a piston 107 is driven by a rod 109. During use, air is placed in the bore 105 and the piston 107 increases the pressure of the air by mechanical force as depicted by motion A, applied thereto by the rod 109 after which the air is evacuated and stored.

One of the problems commonly associated with system 101 is limited efficiency. For example, electricity, gasoline or other fuels are commonly used to create the mechanical force applied to the rod 109 and piston 107 to compress the air.

Accordingly, although great strides have been made in the area of piston compressor systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
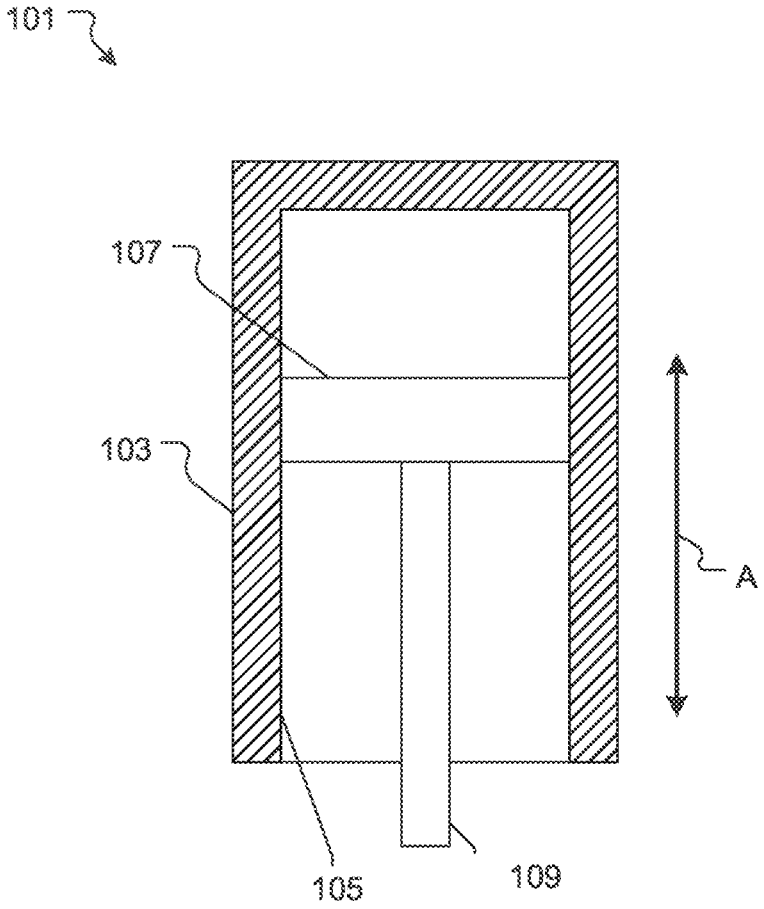
FIG. 1 (Prior Art)
FIG. 1 is a cross-sectional front view of a common piston compressor system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional piston compressor system. Specifically, the invention of the present application provides a continuous pressure change to a fluid with the application of pressure and rotation. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
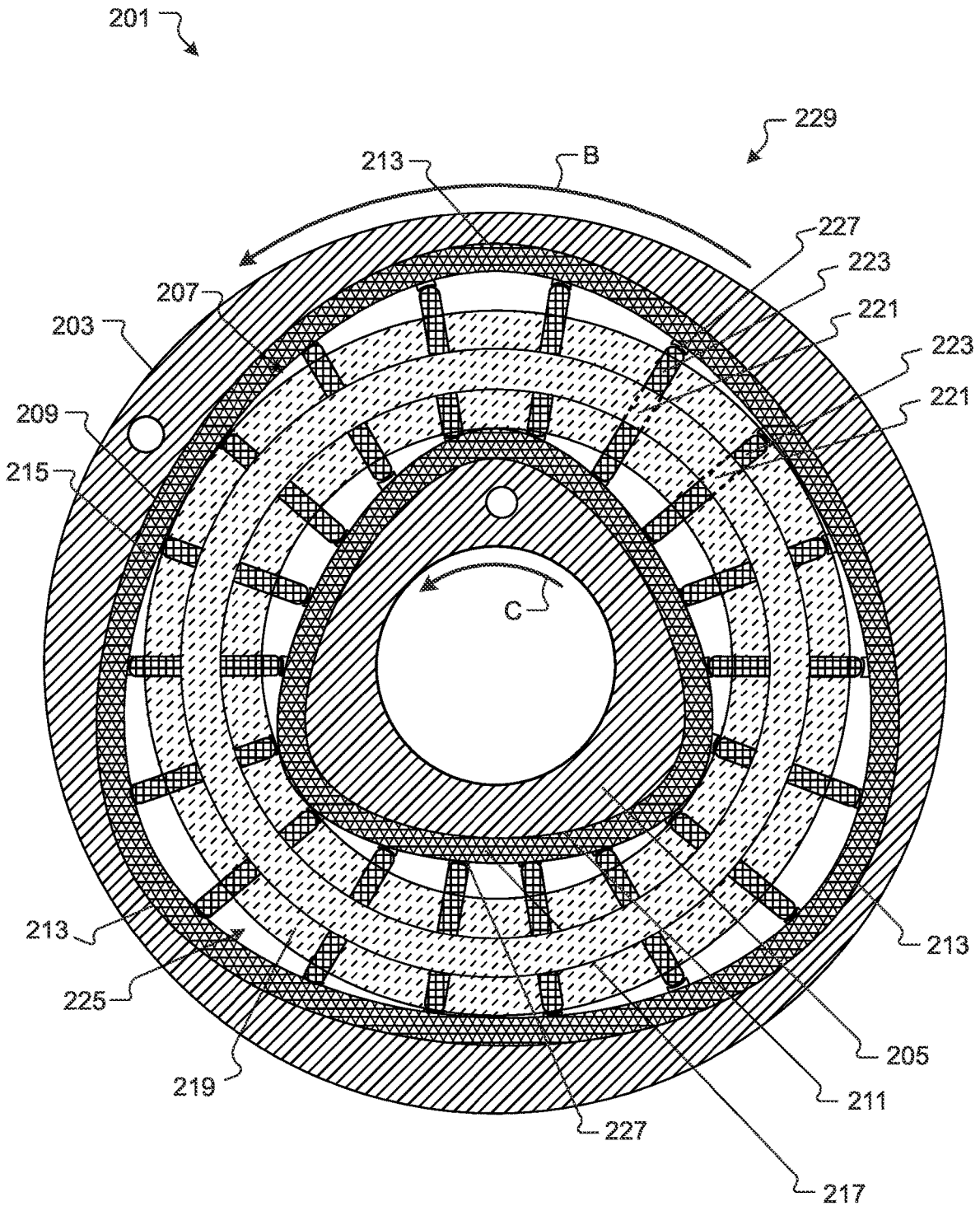
FIG. 2 is a cross-sectional top view of a moving wall multiphase compressor-pump-expander system in accordance with a preferred embodiment of the present application.

Referring now to the drawings wherein like reference characters identify corresponding or similar elements throughout the several views, FIG. 2 depicts a cross-sectional top view of a moving wall multiphase compressor-pump-expander system 201 in accordance with a preferred embodiment of the present application. It will be appreciated that system 201 overcomes one or more of the above-listed problems commonly associated with conventional piston compressor systems.

In the contemplated embodiment, system 201 includes a housing 203 and a central body 205 positioned concentrically within the housing 203. A channel 207 is delineated between a first running surface 209 of the housing 203 and a second running surface 211 of the central body 205, wherein the first running surface 209 and the second running surface 211 are each contoured according to a polygonal profile with a plurality of lobes 213. In various embodiments, the polygonal profile may comprise three or more radially equidistant lobes 213.

A first low friction wall 215 is attached to the first running surface 209 and a second low friction wall 217 is attached to the second running surface 211.

A vane ring 219 is positioned within the channel 207 having a plurality of radial slots 221. A plurality of vanes 223 is slidingly attached within and passes through the plurality of radial slots 221, wherein the plurality of vanes 223 is pivotally attached between the first low friction wall 215 and the second low friction wall 217.

The first low friction wall 215, the second low friction wall 217, the vane ring 219, and the vanes 223 form spaces 225 with variable geometry. The spaces 225 are in fluid communication with a reservoir. More particularly, the spaces 225 are in intermittent fluid communication with a fluid reservoir through intermittently accessible ports of one or more end plates as discussed hereinafter. The housing 203 and the central body 205 are rotationally coupled, and a fluid is injected into the spaces 225 to have its pressure altered as the housing 203 and central body 205 and the vane ring 219 experience rotation relative to each other, changing the geometry of the spaces through compression and/or expansion.

In a contemplated compressor embodiment, in use, a fluid is injected into a space 225 at a low pressure, the housing 203 rotates as depicted by motion B while the central body 205 simultaneously rotates as depicted by motion C. As the housing 203 rotates, the vane ring 219 remains stationary and the vanes 223 adjust their position by sliding in or out of the vane ring 219 as determined by their contact with the first low friction wall 215 and the second low friction wall 217. As this rotation occurs, the size of the spaces 225 changes to alter the pressure of the fluid. As the pressure changes, evacuation ports are opened by the rotation and the fluid exits through a discharge port.

The housing 203 and the central body 205 are made of a porous material, wherein a high-pressure fluid is injected into the porous material of the housing 203 to provide a low friction interface between the housing 203 and the first low friction wall 215. Similarly, a high-pressure fluid is injected into the porous material of the central body 205 to provide a low friction interface between the central body 205 and the second low friction wall 217. In the contemplated embodiments, the first low friction wall 215 and the second low friction wall 217 are each a flexible membrane.

The first low friction wall 215 and the second low friction wall 217 each comprise a plurality of pivot points 227, wherein the plurality of vanes 223 is pivotally attached between the pivot points 227 of the first low friction wall 215 and the second low friction wall 217. The first low friction wall 215 and the second low friction wall 217 are offset by the length of the vanes 223.

It should be appreciated that one of the unique features believed characteristic of the present application is that the spaces 225 enable the continuous change of pressure on the fluid and that as one space contracts, another will begin the cycle. The number of possible concurrent cycles is determined by the number of lobes 213.

In a compressor configuration 229, the vane ring 219 is held stationary, while the housing 203 and the central body 205 are configured to rotate relative to the vane ring 219, as shown by motions B and C.

Figure 3:
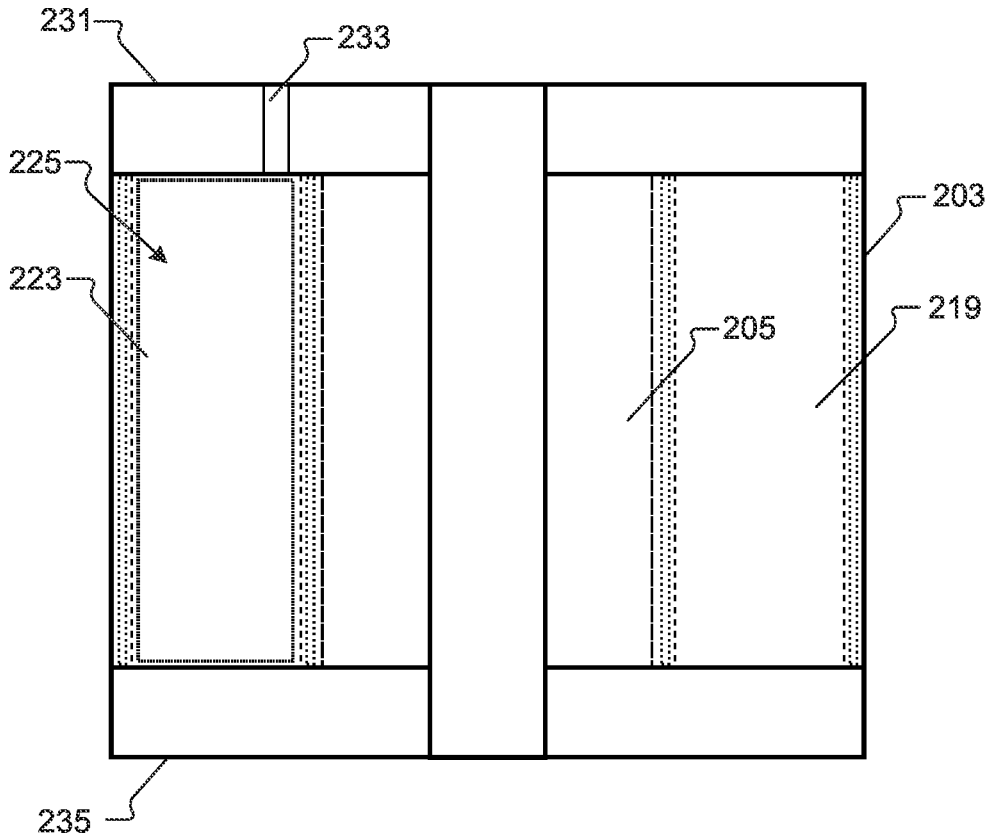
FIG. 3 is an illustrative cross-sectional side view of FIG. 2.

In the contemplated embodiment, referring now to FIG. 3, an inlet end plate 231 and a discharge end plate 235 are further comprised and are rotatably coupled opposite each other to the central body 205 and the housing 203, such that the central body 205, housing 203, low friction walls, vane ring 219, and vanes 223 are positioned between the inlet end plate 231 and the discharge end plate 235.

The inlet end plate 231 comprises a plurality of inlet ports 233 corresponding to the number of lobes 213 of the polygonal profile, wherein the plurality of inlet ports is configured to intermittently inject fluid into the spaces 225 to have its pressure altered as the inlet ports 233 pass sequentially over the spaces 225 during the rotation.

Figure 4:
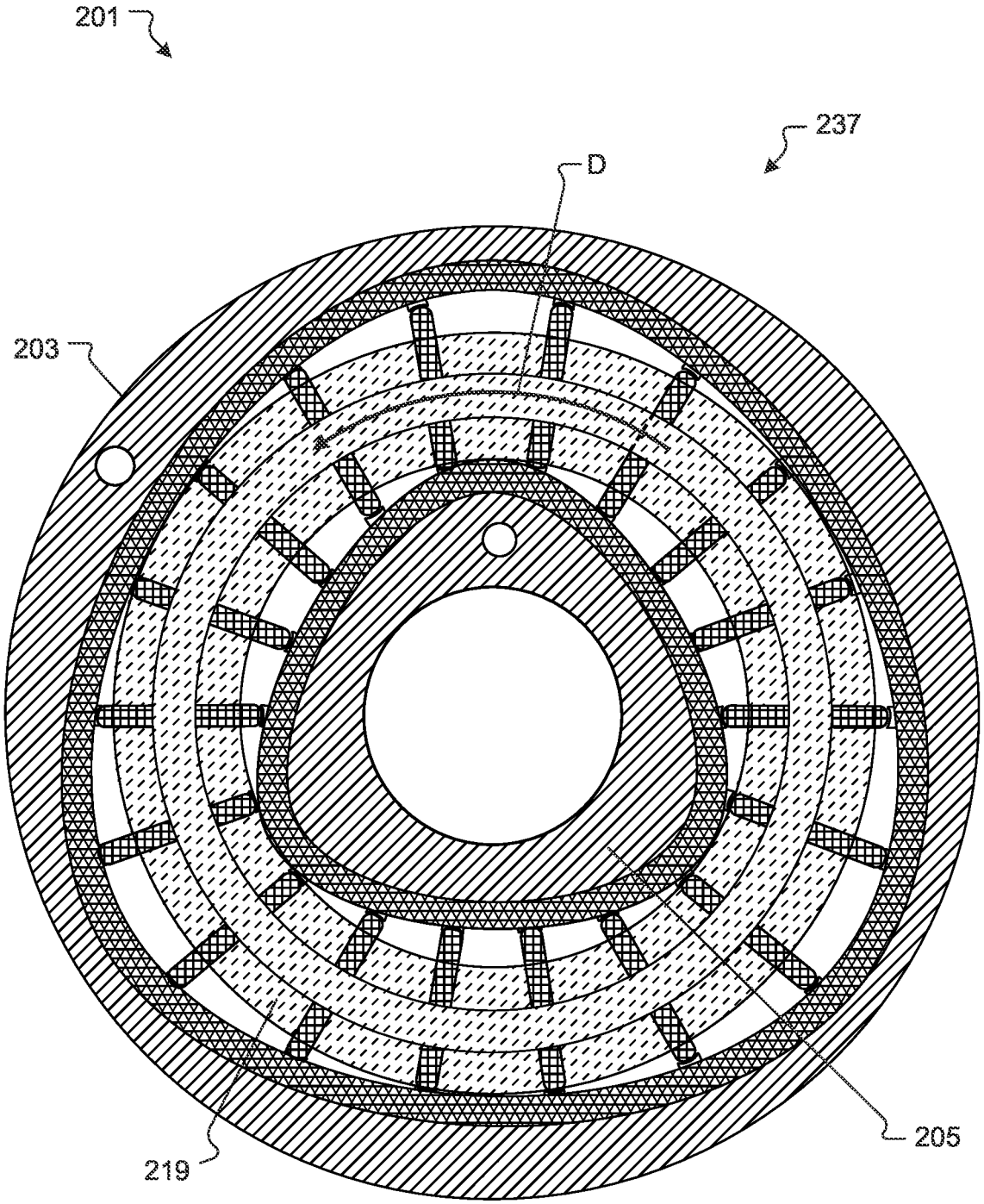
FIG. 4 is an alternative embodiment of FIG. 2.

In an expander configuration 237 shown in FIG. 4, the housing 203 and the central body 205 are held stationary while the vane ring 219 is configured to rotate relative to the housing 203 and the central body 205, as shown by motion D. In the expander configuration 237, the inlet end plate 231 and the discharge end plate 235 are ported so that high pressure gas is introduced into the inlet ports and expanded to the discharge port at a fixed expansion ratio.

Figure 5:
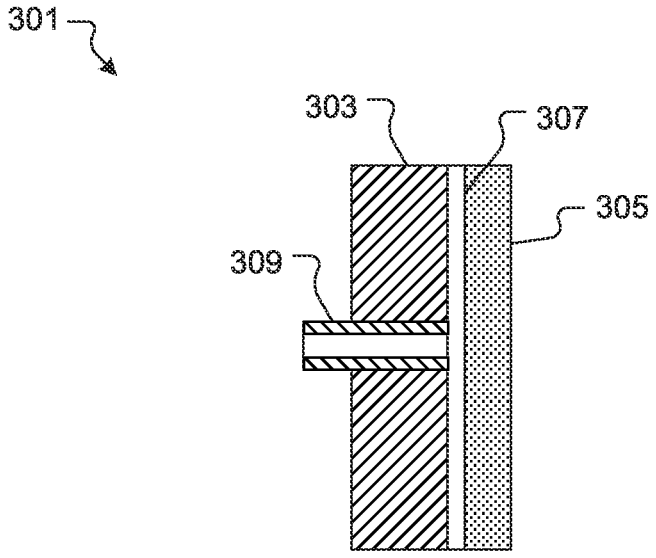
FIG. 5 is a cross-sectional side view of the low friction wall of FIG. 2.

Referring now to FIG. 5, an embodiment of the low friction walls 215, 217 is depicted. Embodiment 301 includes the wall of the channel 303 having a flexible membrane 305 attached thereto with a pocket 307 of fluid between. The pocket 307 is filled by a port 309 that supplies pressurized fluid to the wall 303 and pocket 307. It is contemplated that the housing 203 or the wall of the channel 303 are made of a porous material to allow for even distribution of the pressurized fluid.

Another unique feature believed characteristic of the present application is that the pressurized fluid that fills the pocket 307 of the low friction walls 215, 217 allow for altering the force needed to seal the spaces 225 and reduce the friction of the vanes 223 on the channel 207.

Figure 6:
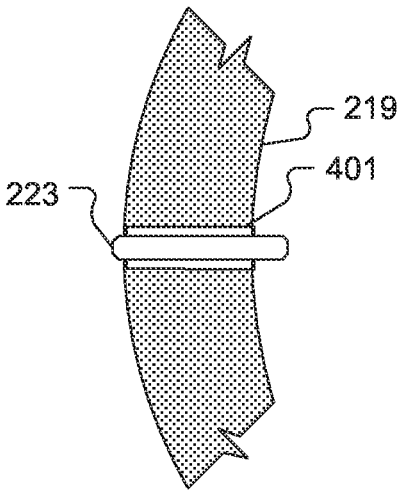
FIG. 6 is a cross-sectional top view of the ring and vanes of FIG. 2.
Figure 7:
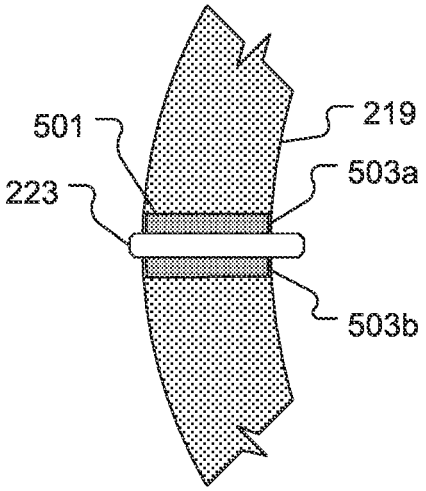
FIG. 7 is a cross-sectional top view of an alternative embodiment of the ring and vanes of FIG. 2.

Referring now to FIG. 6, the vane ring 219 and vanes 223 are depicted. The ring 219 having a slot 401 passing therethrough to allow the vane 211 to slide with respect to it. While the gap between the vane ring 219 and vane 223 is depicted as large it is contemplated that this gap will be very small if it exists. It is contemplated as depicted by FIG. 7, and will be appreciated that the vane ring 219 could have a large slot 501 and that on each side a low friction wall 503 is attached to further reduce the friction of the vanes 211.

It will be understood and appreciated that the system 201 could be used to compress a fluid as depicted and discussed but that the system 201 could also be used to expand a fluid by operating in reverse.

Figure 8:
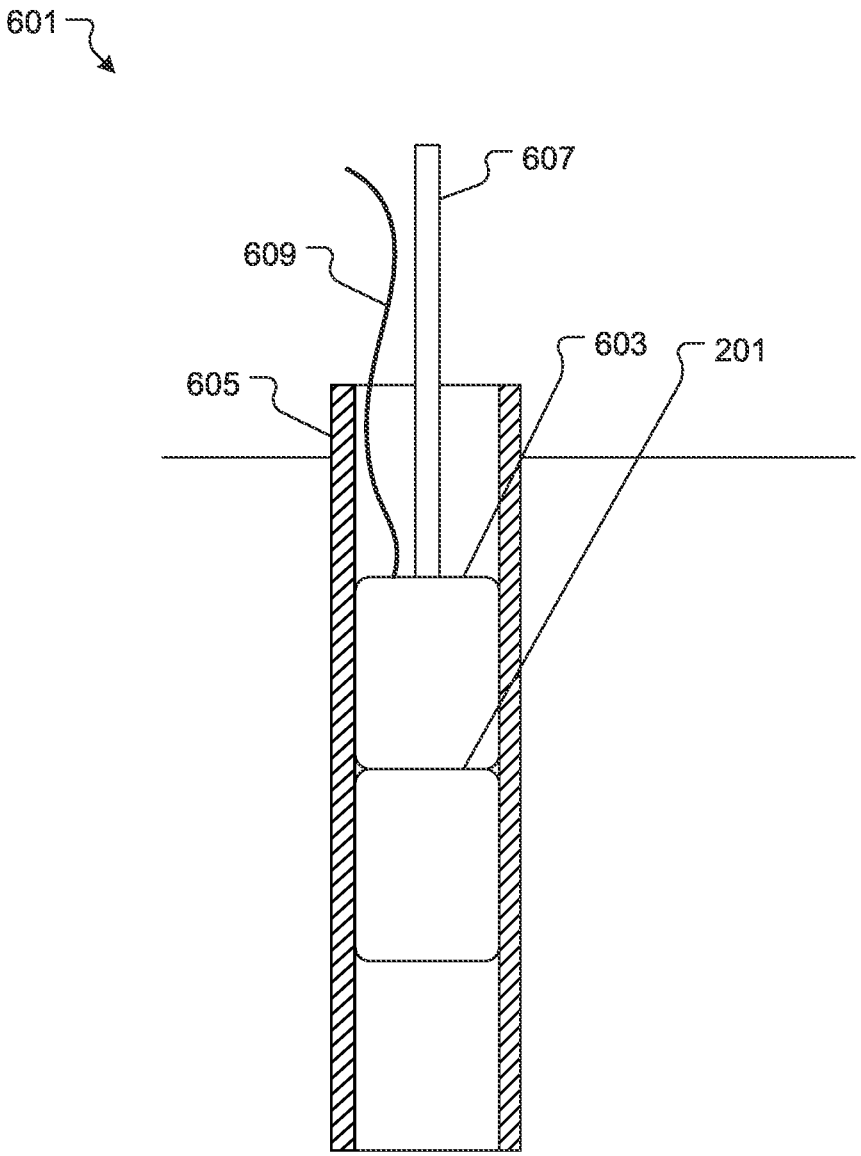
FIG. 8 is a side view of an alternative embodiment of the method of use of the system of FIG. 2.

In another embodiment 601 as depicted by FIG. 8, a second system 603 is coupled to the first system 201 and that the two are placed in a tube 605 and operated by a shaft 607 and pressure line 609. In this way, the first system 201 and second system 603 work together and function as a pump to move fluid through the tube 605.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A moving wall multiphase compressor-pump-expander system comprising:

a housing;

a central body positioned concentrically within the housing, wherein a channel is delineated between a first running surface of the housing and a second running surface of the central body, wherein the first running surface and the second running surface are each contoured according to a polygonal profile with a plurality of lobes;

a first low friction wall being attached to the first running surface;

a second low friction wall being attached to the second running surface;

a ring positioned within the channel having a plurality of radial slots;

a plurality of vanes slidingly attached within and passing through the plurality of radial slots, wherein the plurality of vanes is pivotally attached between the first low friction wall and the second low friction wall;

wherein the first low friction wall, the second low friction wall, the ring and the vanes form spaces with variable geometry;

wherein the housing and the central body are rotationally coupled; and wherein a fluid is injected into the spaces to have its pressure altered as the housing and central body and the ring experience rotation relative to each other.

2. The moving wall multiphase compressor-pump-expander system of claim 1 further comprising:

the housing and the central body being made of a porous material, wherein a high-pressure fluid is injected into the porous material of the housing to provide a low friction interface between the housing and the first low friction wall, and wherein a high-pressure fluid is injected into the porous material of the central body to provide a low friction interface between the central body and the second low friction wall.

3. The moving wall multiphase compressor-pump-expander system of claim 1, wherein the first low friction wall and the second low friction wall are flexible membranes.

4. The moving wall multiphase compressor-pump-expander system of claim 1, wherein the polygonal profile comprises three or more radially equidistant lobes.

5. The moving wall multiphase compressor-pump-expander system of claim 1, wherein the first low friction wall and the second low friction wall are offset by the length of the vanes.

6. The moving wall multiphase compressor-pump-expander system of claim 1, wherein the first low friction wall and the second low friction wall each comprise a plurality of pivot points, and wherein the plurality of vanes is pivotally attached between the pivot points of the first low friction wall and the second low friction wall.

7. The moving wall multiphase compressor-pump-expander system of claim 1, wherein the ring is held stationary and wherein the housing and the central body are configured to rotate relative to the ring in a compressor configuration.

8. The moving wall multiphase compressor-pump-expander system of claim 1, an inlet end plate and a discharge end plate rotatably coupled to the central body and the housing, wherein the central body, the housing, the first and second low friction walls, the ring, and the vanes are positioned between the inlet end plate and the discharge end plate.

9. The moving wall multiphase compressor-pump-expander system of claim 8 further comprising:

the inlet end plate comprising a plurality of inlet ports corresponding to the number of lobes of the polygonal profile, wherein the plurality of inlet ports is configured to inject fluid into the spaces to have its pressure altered.

10. The moving wall multiphase compressor-pump-expander system of claim 1, wherein the housing and the central body are held stationary and wherein the ring is configured to rotate relative to the housing and the central body in an expander configuration, and wherein an inlet end plate and a discharge end plate are ported so that high pressure gas is introduced into inlet ports of the inlet end plate and expanded to the discharge port at a fixed expansion ratio.

* * * * *